United States Patent [19]

Gill

[11] 4,253,254

[45] Mar. 3, 1981

[54] SOUND-PRODUCING DEVICE

[76] Inventor: Courtland P. Gill, 937D N. Placentia, Fullerton, Calif. 92631

[21] Appl. No.: 117,528

[22] Filed: Jan. 31, 1980

[51] Int. Cl.[3] ..... A43B 23/00

[52] U.S. Cl. ..... 36/139

[58] Field of Search ..... 36/139

[56] References Cited

U.S. PATENT DOCUMENTS

| | | | |
|---|---|---|---|
| 3,340,846 | 9/1967 | Maglera | 36/139 |
| 3,878,641 | 4/1975 | Noble | 36/139 |

*Primary Examiner*—Patrick D. Lawson

*Attorney, Agent, or Firm*—Francis X. LoJacono

[57] ABSTRACT

A device for producing sound, wherein the device is adapted to be mounted to the inner surface or the heel rest of a shoe or sandal, and is formed having a main body member with a recess disposed therein, the recess being covered to define a chamber having a noisemaker associated with the chamber, whereby sound is produced as the wearer walks and transfers weight from one foot to the other, thus activating the noisemaker to produce a squeaking or clicking sound.

6 Claims, 6 Drawing Figures

FIG. 1
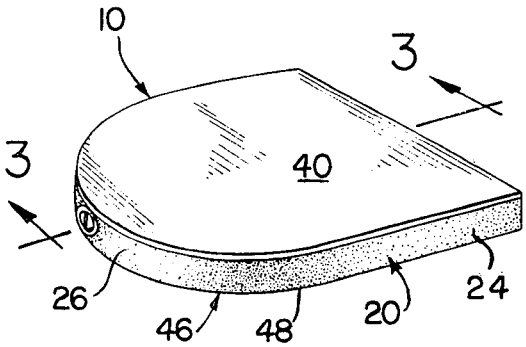
FIG. 2
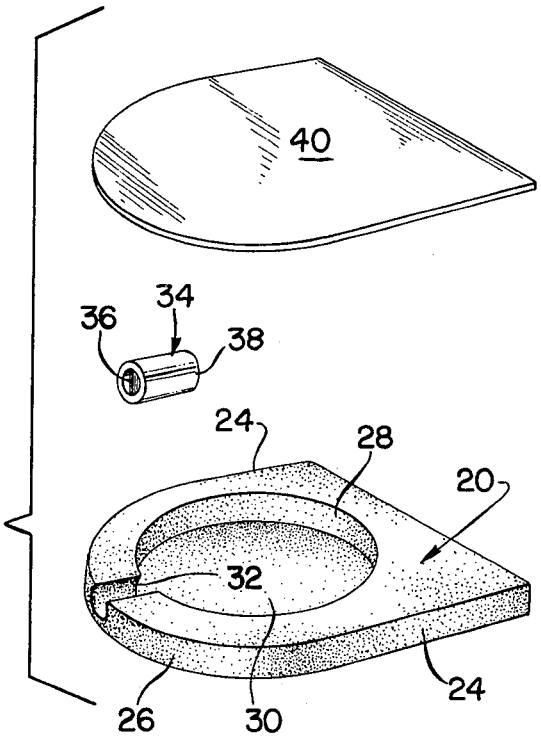
FIG. 3
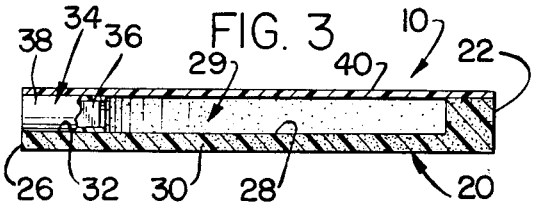
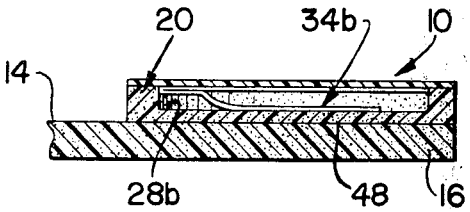
FIG. 6
FIG. 5
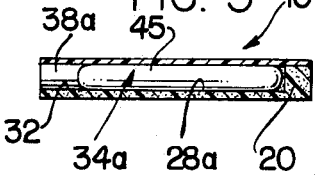
FIG. 4
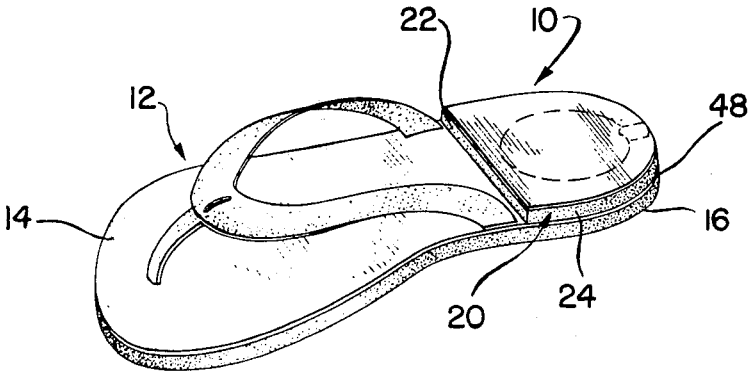

SOUND-PRODUCING DEVICE

BACKGROUND OF THE INVENTION

1. Field of the Invention

This invention relates generally to a sound-producing device, and more particularly to a sound-producing device that is adapted to be worn in combination with a shoe wherein noise is created as the wearer walks.

2. Description of the Prior Art

As is well known in the art, various sound-producing devices have been used on shoes—such as, for example, bells which are tied to the shoe laces. However, to the applicant's knowledge, there is no noisemaking device provided which can be associated and positioned within the shoe, or attached to the heel rest of the shoe, thereby providing an after-market novelty item, especially for children.

SUMMARY OF THE INVENTION

In accordance with the invention herein claimed, a new and novel sound-producing device is established for use or in combination with shoes, sandals, etc. That is, this device is designed to be mounted or positioned over the heel rest of a shoe or sandal, whereby a sound or noise is provided with each step that is taken. Thus, the pressure between the wearer's heel and the shoe will activate the sound-producing device.

The sound-producing device is formed having a main body with a recess disposed therein which is enclosed to define an air chamber by a cover secured over one surface of the main body. A preferred arrangement includes a noisemaker that is positioned to communicate with the air chamber and the atmosphere, wherein the noisemaker is activated when pressure is applied to the chamber.

A second arrangement includes a device that provides a clicking sound—and it, too, is enclosed in the defined chamber. In this arrangement the chamber is not required to be sealed.

It is, therefore, one object of this invention to provide a novel sound-producing device that can be readily mounted to most types of shoes or sandals, and activated by the walking or running of the wearer.

Another object of the invention is to provide a sound producing device that has a squeaker member that is activated by the pressure applied to an interconnected sealed chamber formed between the main body and its cover member.

Still another object of the present invention is to provide a device of this character wherein the noisemaker is arranged within the defined chamber to produce a clicking sound as the weight of the wearer falls against the noisemaker.

It is still another object of the present invention to provide a noisemaking device of this character that has relatively few operating parts.

A still further object of this invention is to provide a device of this character that is relatively inexpensive to manufacture, and that is simple and rugged in construction.

Further objects and advantages of the invention will become apparent as the following description proceeds, and the features of novelty which characterize this invention will be pointed out with particularity in the claims annexed to and forming a part of this specification.

BRIEF DESCRIPTION OF THE DRAWINGS

Referring more particularly to the accompanying drawings, which are for illustrative purposes only:

FIG. 1 is a perspective view of the sound-producing device adapted to be secured to a shoe;

FIG. 2 is an exploded perspective view of the device, showing the three principal members thereof;

FIG. 3 is an enlarged cross-sectional view taken substantially on line 3—3 of FIG. 1;

FIG. 4 is a perspective view of a sandal-type shoe, showing the present invention mounted thereon;

FIG. 5 is a cross-sectional view of another alternative arrangement of the device, wherein the nosiemaker provides a clicking sound when activated.

FIG. 6 is a cross-sectional view of still another alternative arrangement of the device, wherein the noisemaker provides a clicking sound when activated.

DESCRIPTION OF THE PREFERRED EMBODIMENT

Referring to the drawings and more particularly to FIGS. 1 through 4, there is shown a sound-producing device, generally indicated at 10, which is designed to provide a noise when force or pressure is applied to the surfaces of the unit. The device is particularly arranged to be secured to various types of shoes, such as a sandal 12 seen in FIG. 4.

Sandal 12 is suitably provided with a sole member 14 having a typical heel section 16 on which the present invention is secured. Thus, it can be readily understood that the sound producing device 10 is formed so that it is adapted to fit within most shoes.

Accordingly, the sound-producing device comprises a main body member 20 of soft resilient material, such as rubber or foam plastic, having the general configuration of a heel of a shoe. Thus, body 20 includes a flat front wall 22 and opposite side walls 24 which curve rearwardly, defining an arcuate rear wall 26. A circular recess 28 is formed in the main body 20, the recess 28 including a bottom wall 30.

There is further provided in body 20 an enlarged slot 32 which is cut in the rear arcuate wall 26, slot 32 being adapted to receive a noisemaker, indicated generally at 34 as seen in FIG. 2. Noisemaker 34 is shown as being a reed-type having a reed 36 disposed within a tubular sleeve 38. This type of noisemaker is activated by air being forced through sleeve 38, causing reed 36 to vibrate and thereby create a squeak-like sound.

Thus, in order to provide a means to create an air flow through the noisemaker 34, a flexible wall cover 40 is positioned and secured over the upper surface of body 20, thereby enclosing recess 28 and thus defining an air chamber 29. Cover 40 is formed having the same over-all configuration as body 20, cover 40 also enclosing noisemaker 34 within body 20, as illustrated in FIGS. 1 and 3.

Accordingly, it can be understood that when sufficient pressure or weight is placed upon wall cover 40 and body 20 they will be depressed, forcing air from chamber 29 so as to pass through noisemaker 34 and thus creating a sound. Therefore, when a pair of shoes or sandals such as 12 are provided with sound producing units 10, noise will be made as the wearer walks or runs, causing the wearer's heels to alternately engage each unit.

FIG. 5 is a cross-sectional view of an alternative arrangement of a squeaker-type noisemaker 34*a*, wherein recess 28*a* formed in body 20 comprises a bulb-like housing 45 having an integrally formed sleeve 38*a* which projects through slot 32. Thus, bulb-like housing 45—rather than recess 28*a*—defines an air chamber.

It is further contemplated that another arrangement of a noisemaker can be adapted to be disposed in recess 28*b*, as illustrated in FIG. 6. The noisemaker, designated generally at 34*b*, is designed to provide a clicking sound. Noisemaker 34*b* comprises a bendable strip or strips of metal arranged to be flexed when pressure is applied to unit 10. As pressure is applied, the metal strip is allowed to bend in a snapping manner, thereby creating a clicking sound.

Various securing means are contemplated so as to readily mount the device 10 to the shoe surface. One such means, indicated at 46, includes a contact adhesive material 48 coated to the bottom surface of body 20 and having a protective paper cover 50 that is readily peeled off for exposing the adhesive surface 48.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A sound-producing device adapted to be secured to at least one shoe and positioned to be engaged by the heel of the wearer, the device comprising:

a soft pliable body member having an upper and a bottom surface;

a recess formed in said body member, with the opening thereof in said upper surface;

a noisemaker means adapted to be received in said recess; and a cover wall mounted to the upper surface to enclose said noisemaker means in said body, wherein said noisemaker is activated by the wearer thereof.

2. A sound-producing device as recited in claim 1, wherein said body member includes a slot therein in communication with said recess, and wherein said recess defines an air chamber.

3. A sound-producing device as recited in claim 2, wherein said noisemaker comprises:

a tubular sleeve member positioned in said slot, one end of said tubular sleeve communicating with said air chamber and the opposite end thereof communicating with the atmosphere, to allow air to pass therethrough; and a reed disposed in said sleeve arranged to vibrate and produce sound as air passes therethrough.

4. A sound-producing device as recited in claim 3, wherein said bottom surface is provided with a securing means.

5. A sound-producing device as recited in claim 4, wherein said securing means comprises a contact adhesive having a protective cover removably disposed thereon.

6. A sound-producing device as recited in claim 1, wherein said body member includes a slot therein in communication with said recess, and wherein said noisemaker comprises a bulb-like housing, defining an air chamber, positioned in said recess, a sleeve member being integrally formed with said housing and adapted to be received in said slot, said sleeve including a reed member activated to make noise by the air forced from said air chamber.

* * * * *